US010004369B1

(12) United States Patent
Guidry

(10) Patent No.: US 10,004,369 B1
(45) Date of Patent: Jun. 26, 2018

(54) TOILET LID LIGHT

(71) Applicant: Richard Guidry, West Monroe, LA (US)

(72) Inventor: Richard Guidry, West Monroe, LA (US)

( * ) Notice: Subject to any disclaimer, the term of this patent is extended or adjusted under 35 U.S.C. 154(b) by 93 days.

(21) Appl. No.: 15/244,060

(22) Filed: Aug. 23, 2016

(51) Int. Cl.

| | |
|---|---|
| ***F21L 4/00*** | (2006.01) |
| ***A47K 17/02*** | (2006.01) |
| ***A47K 13/24*** | (2006.01) |
| ***F21S 9/02*** | (2006.01) |
| ***F21V 23/04*** | (2006.01) |
| ***F21V 33/00*** | (2006.01) |
| ***F21V 21/08*** | (2006.01) |
| ***H05B 33/08*** | (2006.01) |
| *F21Y 115/10* | (2016.01) |

(52) U.S. Cl.
CPC ..... *A47K 17/02* (2013.01); *A47K 13/24* (2013.01); *F21S 9/02* (2013.01); *F21V 21/08* (2013.01); *F21V 23/0464* (2013.01); *F21V 23/0492* (2013.01); *F21V 33/0044* (2013.01); *H05B 33/0887* (2013.01); *F21Y 2115/10* (2016.08)

(58) Field of Classification Search
CPC . A47K 17/02; A47K 13/24; F21S 9/02; F21V 23/0464; F21V 23/0492; F21V 21/08; F21Y 2115/10
See application file for complete search history.

(56) References Cited

U.S. PATENT DOCUMENTS

| | | | | | |
|---|---|---|---|---|---|
| 4,413,364 | A * | 11/1983 | Bittaker | A47K 17/00 | 362/131 |
| 4,849,742 | A * | 7/1989 | Warrington | G08B 21/22 | 340/545.6 |
| 5,003,648 | A * | 4/1991 | Anderson | A47K 13/30 | 4/314 |
| 5,032,957 | A * | 7/1991 | Canfield | A47B 81/00 | 362/133 |
| 5,263,209 | A * | 11/1993 | Pattee | A47K 13/24 | 362/101 |
| 5,664,867 | A * | 9/1997 | Martin | A47K 13/00 | 340/686.1 |
| 5,748,096 | A * | 5/1998 | Kaufer | A47K 13/24 | 340/686.1 |
| D571,031 | S | 6/2008 | Perkins | | |
| 8,398,257 | B1 | 3/2013 | Paulus | | |
| 9,445,699 | B2 * | 9/2016 | Mangrum, Jr. | F21V 33/004 | |
| 2005/0071917 | A1 | 4/2005 | Landon | | |
| 2006/0042004 | A1 | 3/2006 | Busch | | |
| 2007/0294821 | A1 | 12/2007 | Griner | | |

FOREIGN PATENT DOCUMENTS

| | | |
|---|---|---|
| JP | 2004261221 A1 | 4/2012 |

* cited by examiner

*Primary Examiner* — Ali Alavi

(57) ABSTRACT

The toilet lid light is a position sensitive light that is adapted for use with a toilet. The toilet lid light is a device that illuminates the toilet during use in periods of darkness. Specifically, the toilet lid light is illuminated when the toilet seat is put in the up position for the purposes of: 1) providing visual feedback regarding the location of urinary tract discharge relative to the boundaries of the toilet bowl during use; and, 2) providing visual feedback regarding the position of the toilet seat for the purpose of assisting in the proper subsequent use of the toilet. The toilet lid light comprises a lamp, a housing, and a fastener. The lamp is contained within the housing. The fastener attaches the housing to the bottom side of the toilet seat.

5 Claims, 5 Drawing Sheets

TOILET LID LIGHT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of lighting and the details of lighting devices, more specifically, a structural combination of a lighting device with sanitary equipment.

A toilet is a well-known and commonly seen piece of sanitary equipment. Within this disclosure, a toilet is further defined with a toilet seat and a toilet bowl. The toilet seat is further defined with a top side, a bottom side, an up position, and a down position. The toilet seat rotates between the up position and the down position. In the down position, the toilet seat is proximal to the toilet bowl. In the up position, the toilet seat is distal from the toilet bowl. When the toilet seat is in the down position, the bottom side of the toilet seat is the surface of the toilet seat is that proximal to the toilet bowl. The top side of the toilet seat is the surface of the toilet seat that is distal from the bottom side of the toilet seat.

SUMMARY OF INVENTION

The toilet lid light is a position sensitive light that is adapted for use with a toilet. The toilet lid light is a device that illuminates the toilet during use in periods of darkness. Specifically, the toilet lid light is illuminated when the toilet seat is put in the up position for the purposes of: 1) providing visual feedback regarding the disposal location of urinary discharge relative to the boundaries of the toilet bowl during use; and, 2) providing visual feedback regarding the position of the toilet seat for the purpose of assisting in the proper subsequent use of the toilet.

These together with additional objects, features and advantages of the toilet lid light will be readily apparent to those of ordinary skill in the art upon reading the following detailed description of the presently preferred, but nonetheless illustrative, embodiments when taken in conjunction with the accompanying drawings.

In this respect, before explaining the current embodiments of the toilet lid light in detail, it is to be understood that the toilet lid light is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet lid light.

It is therefore important that the claims be regarded as including such equivalent construction insofar as they do not depart from the spirit and scope of the toilet lid light. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
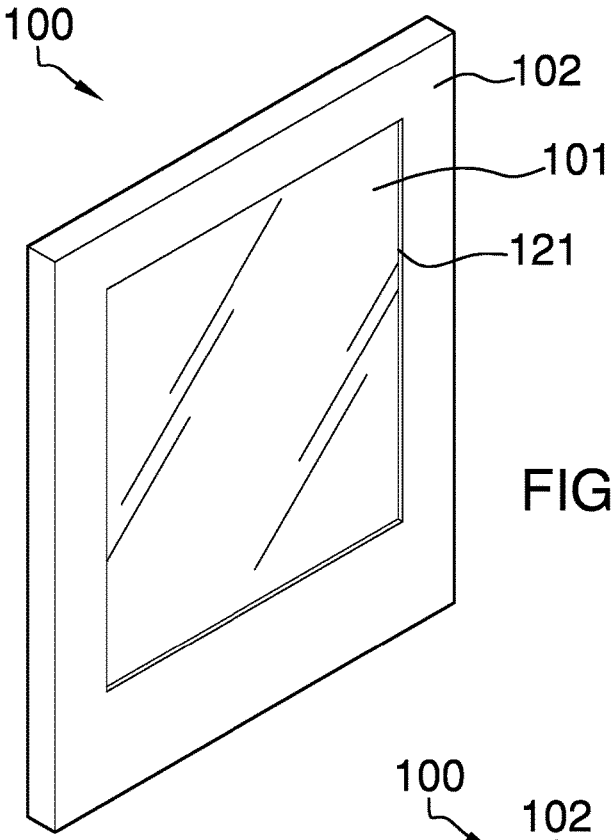
FIG. 1 is a perspective view of an embodiment of the disclosure.
Figure 2:
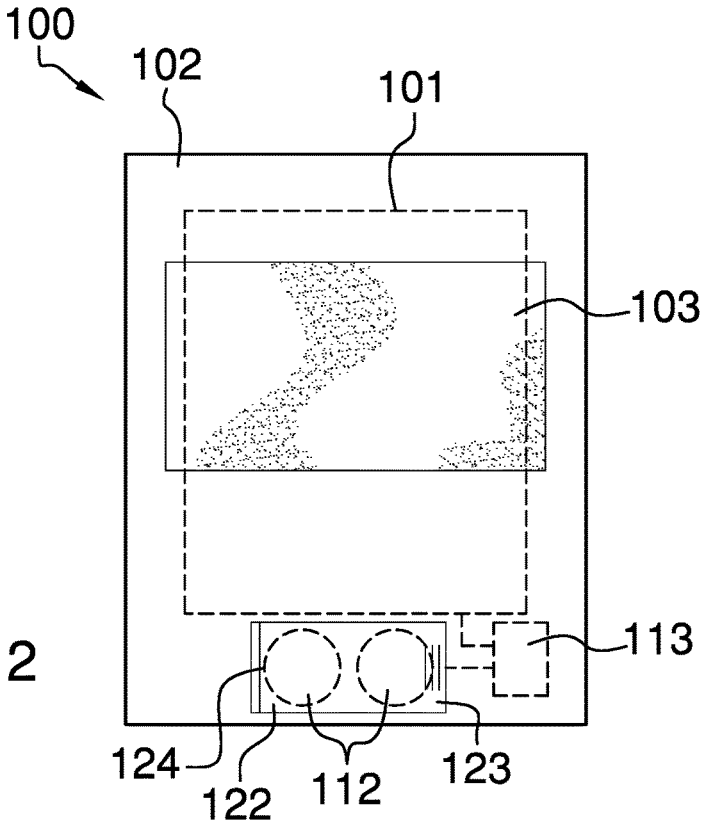
FIG. 2 is a rear view of an embodiment of the disclosure.
Figure 3:
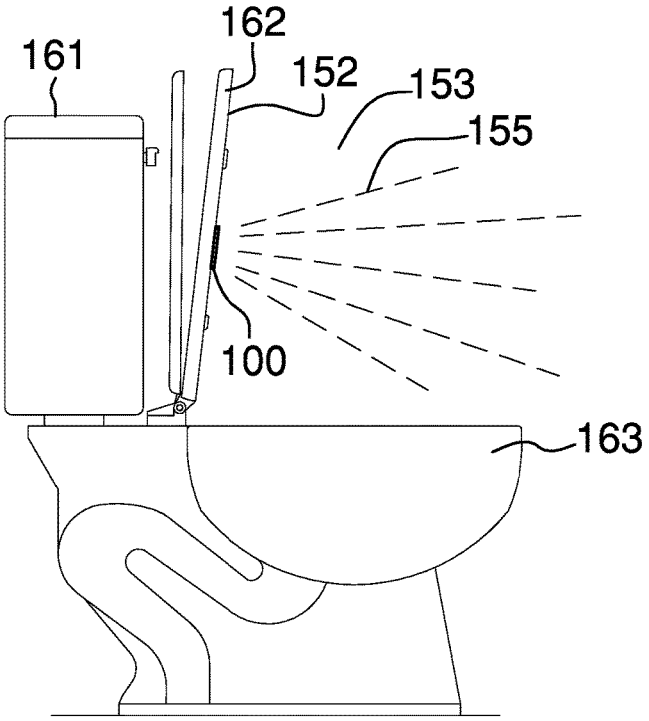
FIG. 3 is a first side view of an embodiment of the disclosure.
Figure 4:
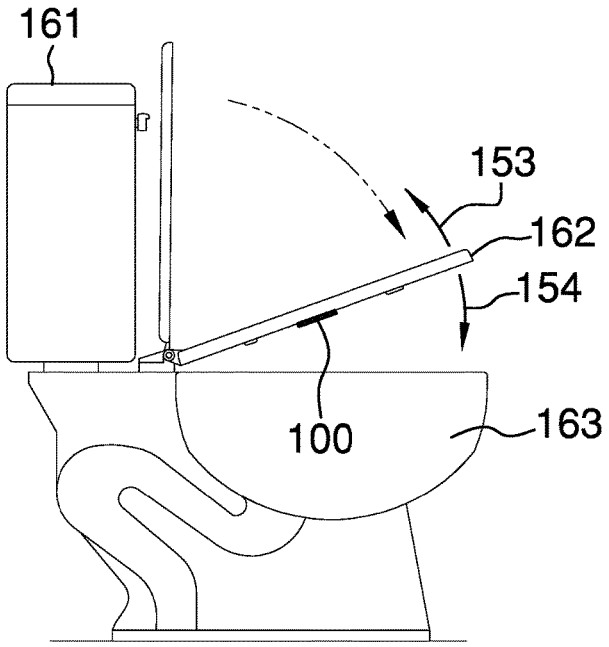
FIG. 4 is a second side view of an embodiment of the disclosure.
Figure 5:
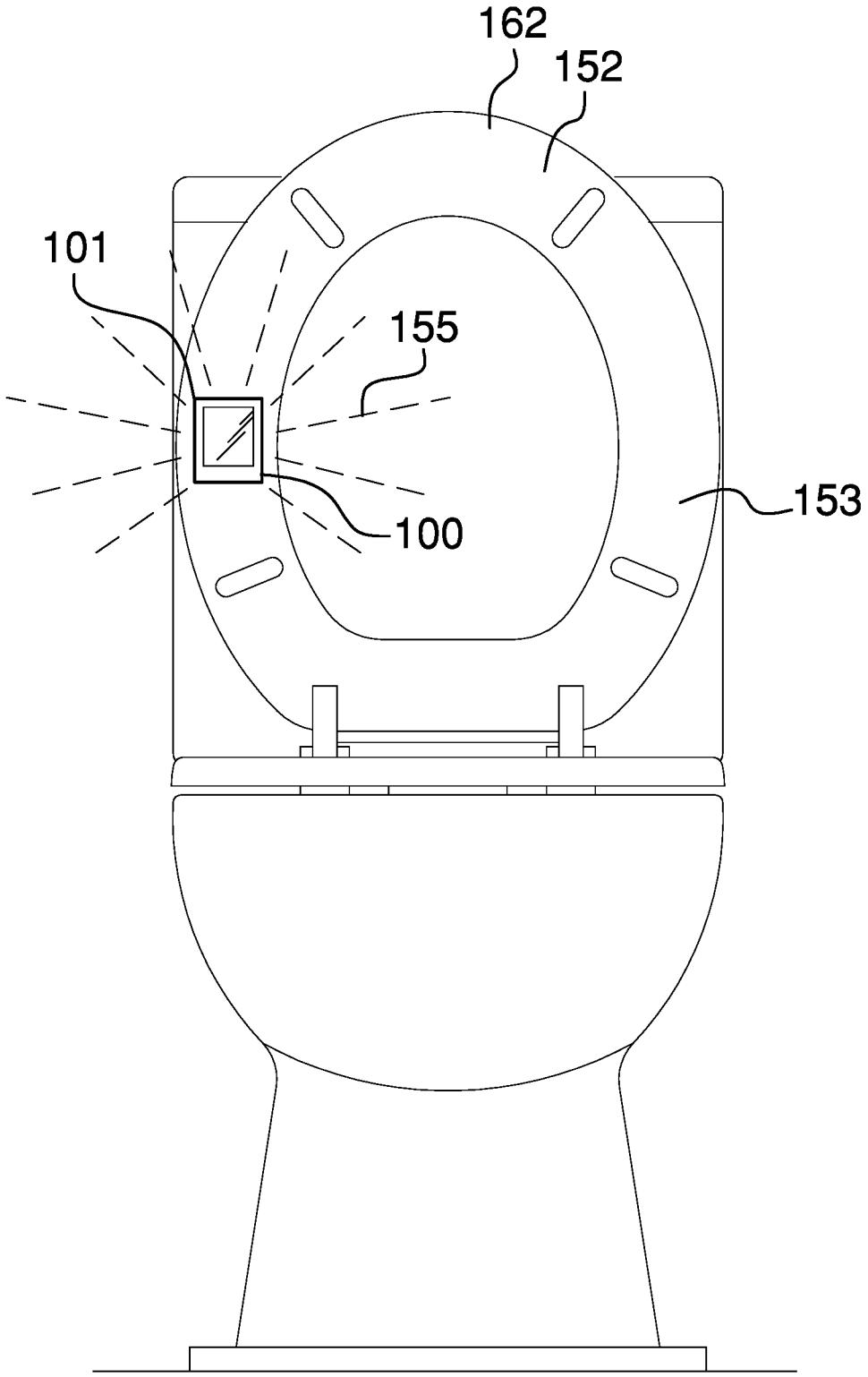
FIG. 5 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The toilet lid light 100 (hereinafter invention) comprises a lamp 101, a housing 102, and a fastener 103. The lamp 101 is contained within the housing 102. The fastener 103 attaches the housing 102 to the bottom side 152 of a seat 162 of a toilet 161. The invention 100 is a position sensitive light that is adapted for use with the toilet 161. The invention 100 is a device that illuminates 155 the toilet 161 during use in periods of darkness. Specifically, the invention 100 is illuminated 155 when the toilet 161 seat 162 is put in the up position 153 for the purposes of: 1) providing visual feedback regarding the disposal location of urinary discharge relative to the boundaries of the toilet 161 bowl 163 during use; and, 2) providing visual feedback regarding the position of the toilet 161 seat 162 for the purpose of assisting in the proper subsequent use of the toilet 161.

The lamp 101 comprises one or more LEDs 111, a battery 112, and a tilt switch 113. The one or more LEDs 111, the battery 112, and the tilt switch 113 are connected as a series circuit.

Each of the one or more LEDs 111 is a light emitting diode that is used to illuminate 155 the toilet 161 during use. The one or more LEDs 111 is selected from the group consisting of: 1) a collection one or more individual LEDs that are individually incorporated into the lamp 101; 2) one or more readily and commercially available LED bar lights, often marketed with the term "night stick" or "night light" that are incorporated as one or more units into the lamp 101; or, 3) one or more readily and commercially LED light strips that are incorporated as one or more units into the lamp 101. The battery 112 is a readily and commercially available battery 112. The battery 112 powers the one or more LEDs 111. The tilt switch 113 is a readily and commercially available tilt switch 113. The tilt switch 113 is designed to close when the toilet 161 seat 162 is placed in the up position 153 and to open when the toilet 161 seat 162 is placed in the down position 154. In the first potential embodiment of the disclosure, the selected tilt switch 113 closes when the angle between the tilt switch 113 and the direction that is perpendicular to the force of gravity is greater than 80 degrees. The tilt switch 113 is selected from the group consisting of a mercury switch or a metal ball tilt switch.

In a second potential embodiment of the disclosure, the lamp 101 described in the first potential embodiment of the disclosure further comprises a limit resistor 115. In this scenario, the limit resistor 115 is placed in series into the series circuit containing the one or more LED 111, the battery 112, and the tilt switch 113. The purpose of the limit resistor 115 is to protect the one or more LEDs 111 as well as other components of the lamp 101 by limiting limit current flow through the series circuit.

In a third potential embodiment of the disclosure, the lamp 101 described in the first potential embodiment of the disclosure further comprises a photoswitch 114. The purpose of the photoswitch 114 is to limit the operation of the invention 100 to periods of darkness. Specifically, the photoswitch 114 is a readily and commercially available switch that closes in response to the exposure of the photoswitch 114 to darkness. The switch of the photoswitch 114 opens in response to the exposure of the photoswitch 114 to light. The photoswitch 114 is placed in series into the series circuit containing the one or more LED 111, the battery 112, and the tilt switch 113.

In a fourth potential embodiment of the disclosure, the lamp 101 described in the first potential embodiment of the disclosure further comprises the limit resistor 115. In this scenario, the limit resistor 115 is placed in series into the series circuit containing the one or more LED 111, the battery 112, the tilt switch 113, and the photoswitch 114. The purpose of the limit resistor 115 is to protect the one or more LEDs 111 as well as other components of the lamp 101 by limiting limit current flow through series circuit.

Figure 6:
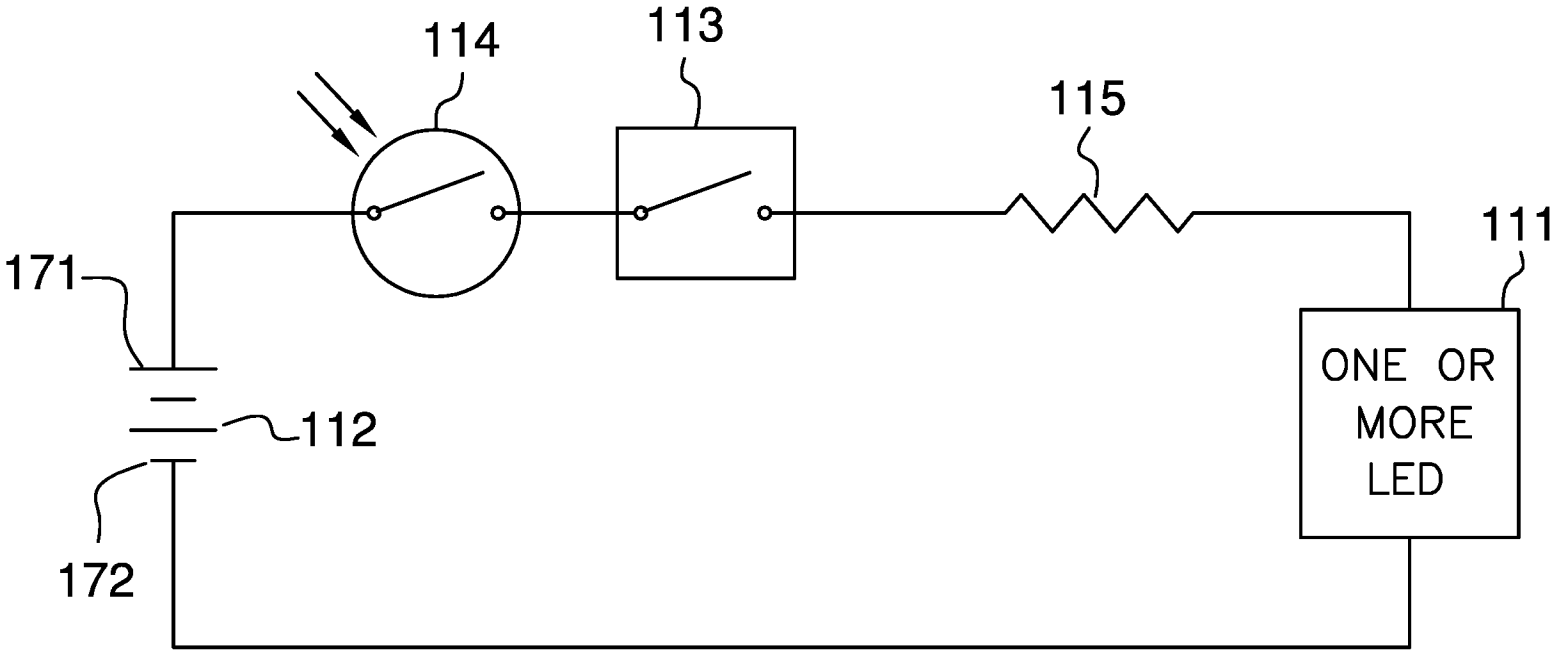
FIG. 6 is a schematic view of an embodiment of the disclosure.
Figure 7:
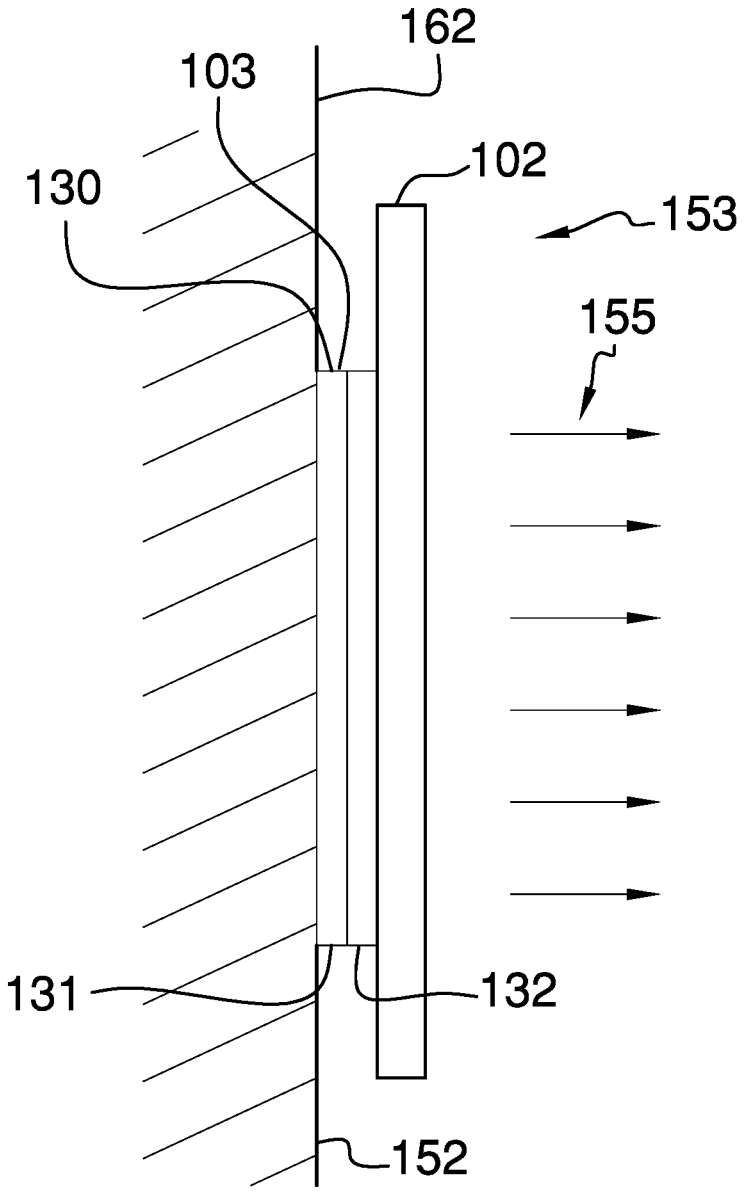
FIG. 7 is a side view of an embodiment of the disclosure.

As shown most clearly in FIG. 6, the lamp 101 described in the fourth potential embodiment of the disclosure is wired as follows: The cathode 171 of the battery 112 connects to the photoswitch 114. The photoswitch 114 connects to the tilt switch 113. The tilt switch 113 connects to the limit resistor 115. The limit resistor 115 connects to each of the one or more LEDs 111. Each of the one or more LEDs 111 connects to the anode 172 of the battery 112. Those skilled in the electrical arts will recognize that: 1) each of the potential embodiments described in this disclosure can be formed from the fourth potential embodiment of the disclosure by shorting out one or more of the described components; and, 2) that the relative position of any two of the described components can be interchanged.

The housing 102 is a rigid case that contains the lamp 101. In the first potential embodiment of the disclosure, as shown most clearly in FIGS. 1 and 2, the housing 102 is a hollow rectangular block shaped structure that further comprises a first aperture 121, a second aperture 122, and a battery compartment door 123. The first aperture 121 is a hole that is formed through the surface of the housing 102 such that the one or more LEDs 111 can be mounted within the first aperture 121 in a manner that allows each of the one or more LEDs 111 to illuminate 155 the toilet 161 when activated. As shown most clearly in FIG. 2, the second aperture 122 and the battery compartment door 123 are mounted on the surface of the housing 102 that is distal from the first aperture 121. The second aperture 122 provides access to a battery mount device 124 that is positioned within the housing 102 to securely receive and store the battery 112. The second aperture 122 provides external access to the battery mount device 124 such that the battery 112 can be replaced when necessary. The battery compartment door 123 is attached to a location selected form the group consisting of the second aperture 122 or the housing 102. The battery compartment door 123 is attached such that the battery compartment door 123 blocks access to the interior of the housing 102 through the second aperture 122.

The fastener 103 attaches the housing 102 to the bottom side 152 of the toilet 161 seat 162 such that the first aperture 121 is distal from the bottom side 152 of the toilet 161 seat 162. In the first potential embodiment of the disclosure, the fastener 103 is a hook and loop fastener 130. The hook and loop fastener 130 is preferred because it allows the invention 100 to be removed from the toilet 161 seat 162 allowing the battery 112 to be readily replaced. The hook and loop fastener 130 further comprises a first hook or loop surface 131 and a second hook or loop surface 132. As shown most clearly in FIG. 7, a first adhesive attaches the first hook or loop surface 131 to the bottom side 152 of the toilet 161 seat 162. A second adhesive further attaches the second hook or loop surface 132 to the surface of the housing 102 where the second aperture 122 is formed. To attach the invention 100 to the bottom side 152 of the toilet 161 seat 162, the second hook or loop surface 132 is pressed against the first hook or loop surface 131.

Once a battery 112 is installed in the lamp 101 and the housing 102 is installed to the bottom side 152 of the toilet 161 seat 162, the operation of the invention 100 is automatic.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter the anode refers to: 1) the positive terminal of a power consuming electrical circuit element; 2) the negative terminal of a discharging battery or an electrical power source; and, 3) the positive terminal of a charging battery. As a further practical matter the cathode refers to: 1) the negative terminal of a power consuming electrical circuit element; 2) the positive terminal of a discharging battery or an electrical power source; and, 3) the negative terminal of a charging battery. Diode: As used in this disclosure, a diode is a two terminal semiconductor device that allows current flow in only one direction. The two terminals are called the anode and the cathode.

Battery: As used in this disclosure, a battery is a container consisting of one or more cells, in which chemical energy is converted into electricity and used as a source of power.

Door: As used in this disclosure, a door is a movable or removable barrier that is attached to the wall of a room or the surface of a container for the purpose of allowing or preventing access through an aperture into the room or container.

Fastener: As used in this disclosure, a fastener is a device that is used to join or affix two objects. Fasteners generally comprise a first element which is attached to the first object and a second element which is attached to the second object such that the first element and the second element join to affix the first object and the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Housing: As used in this disclosure, a housing is a rigid casing that encloses and protects one or more devices.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photoswitch: As used in this disclosure, a photoswitch is a switch that is actuated with light. The operation of a photoswitch is often based on the use of a photoelectric device.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tilt Switch: As used in this disclosure, a tilt switch is a switch that is actuated by angle of the switch relative to a reference direction. In many applications, the reference direction will be the force of gravity. Common tilt switch technologies include, but are not limited to, mercury switches and metal ball tilt switches.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lighting device comprising:

a lamp, a housing, and a fastener;

wherein the lighting device is device that is adapted for use with a toilet;

wherein the toilet further comprises a toilet seat;

wherein the toilet seat is further defined with a bottom side;

wherein the toilet seat is further defined with an up position and a down position;

wherein the lamp is contained within the housing;

wherein the fastener attaches the housing to the bottom side of a toilet seat;

wherein the lighting device is a device that illuminates the toilet during use in periods of darkness;

wherein the lighting device is illuminates when the toilet seat is put in the up position;

wherein the lamp comprises one or more LEDs, a battery, and a tilt switch;

wherein the one or more LEDs, the battery, and the tilt switch are connected as a series circuit;

wherein each of the one or more LEDs is a light emitting diode that illuminates the toilet;

wherein the one or more LEDs is selected from the group consisting of a collection one or more individual LEDs, or one or more LED bar lights, or one or more LED light strips;

wherein the battery powers each of the one or more LEDs;

wherein the tilt switch closes when the toilet seat is placed in the up position;

wherein the tilt switch opens when the toilet seat is placed in the down position;

wherein the housing is a rigid case that contains the lamp;

wherein the housing is a hollow rectangular block shaped structure that further comprises a first aperture, a second aperture, and a battery compartment door;

wherein the first aperture is a hole that is formed through the surface of the housing;

wherein the one or more LEDs mounted within the first aperture such that each of the one or more LEDs to illuminates the toilet when activated;

wherein the second aperture and the battery compartment door are mounted on the surface of the housing that is distal from the first aperture;

wherein the second aperture provides access to a battery mount device that is positioned within the housing;

wherein the battery compartment door attaches to the a location selected form the group consisting of the second aperture or the housing;

wherein the battery compartment door to the selected location such that the battery compartment door blocks access to the interior of the housing through the second aperture;

wherein the fastener attaches the housing to the bottom side of the toilet seat such that the first aperture is distal from the bottom side of the toilet seat;

wherein the fastener is a hook and loop fastener;

wherein the lamp further comprises a photoswitch;

wherein the photoswitch limits the operation of the lighting device to periods of darkness;

wherein the photoswitch is placed in series into the series circuit containing the one or more LED, the battery, and the tilt switch;

wherein the photoswitch opens in response to the exposure of the photoswitch to light;

wherein the photoswitch closes in response to the exposure of the photoswitch to darkness;

wherein the lamp further comprises a limit resistor;

wherein the limit resistor is placed in series into the series circuit containing the one or more LED, the battery, the tilt switch, and the photoswitch.

2. The lighting device according to claim 1 wherein the tilt switch is a mercury switch.

3. The lighting device according to claim 1 wherein the cathode of the battery connects to the photoswitch;

wherein the photoswitch connects to the tilt switch;

wherein the tilt switch connects to the limit resistor;

wherein the limit resistor connects to each of the one or more LEDs;

wherein each of the one or more LEDs connects to the anode of the battery.

4. The lighting device according to claim 1 is a metal ball tilt switch.

5. The lighting device according to claim 3 wherein the tilt switch closes when the angle between the tilt switch and the direction that is perpendicular to the force of gravity is greater than 80 degrees;

wherein the tilt switch opens when the angle between the tilt switch and the direction that is perpendicular to the force of gravity is lesser than 80 degrees.

* * * * *